US005193427A

United States Patent [19]

Johannsen

[11] Patent Number: 5,193,427

[45] Date of Patent: Mar. 16, 1993

[54] WIRE MARKER DISPENSER

[75] Inventor: Gerald W. Johannsen, Round Rock, Tex.

[73] Assignee: Minnesota Mining and Manufacturing Company, St. Paul, Minn.

[21] Appl. No.: 828,307

[22] Filed: Jan. 30, 1992

[51] Int. Cl.[5] ..... B26D 1/30; G09F 3/00

[52] U.S. Cl. ..... 83/607; 83/649; 83/949; 40/316; 226/52

[58] Field of Search ..... 40/316; 226/52; 83/649, 83/949, 522.19, 607; 221/32

[56] References Cited

U.S. PATENT DOCUMENTS 2,604,166 7/1952 Turner ..... 83/649 X
3,050,853 8/1962 Domeny ..... 83/649 X
3,176,572 4/1965 Comet ..... 83/522.19 X
3,456,537 7/1969 Quinn ..... 83/649 X
3,650,059 3/1972 Johnson ..... 40/316
4,643,059 2/1987 Phillips et al. ..... 83/649 X

*Primary Examiner*—Douglas D. Watts
*Assistant Examiner*—Kenneth E. Peterson
*Attorney, Agent, or Firm*—Gary L. Griswold; Walter N. Kirn; David W. Anderson

[57] ABSTRACT

A dispenser for a series of wire markers includes a slot which accepts the point of a stylus inserted through a hole in the wire marker, which slot extends to a predetermined position adjacent a cutting blade. Movement of the stylus along the slot advances the wire marker to the proper position for cutting.

4 Claims, 2 Drawing Sheets

WIRE MARKER DISPENSER

FIELD OF THE INVENTION

The present invention relates generally to markers used for the identification of a cylindrical object, and more particularly, to a dispenser which facilitates the handling of a series of wire markers, application of indicia to the wire markers and cutting of an individual wire marker from the series.

BACKGROUND OF THE INVENTION

FIG. 1 illustrates a wire marker 10 as it is attached to an electrical wire 12 for identification of the same. The wire marker 10 usually consists of a blank of flexible material such as cardboard or, preferably, plastic which has holes adjacent each end. Bending of the wire marker 10 allows the wire 12 to be passed through the holes. Resiliency of the wire marker 10 causes the edges of the holes to grip the wire 12 and maintain the wire marker 10 in a desired position along the wire 12. Indicia 14 may be applied to the wire marker 10 by printing, typing or writing to identify the electrical circuit to which the wire 12 is a part. The wire marker 10 pictured in FIG. 1 is conventional and forms no part of the present invention. The present invention is directed to a dispenser for a series of wire markers 10 which facilitates the handling of a series of such markers 10 wound into a spool.

SUMMARY OF THE INVENTION

The present invention is a dispenser adapted to dispense in seriatim fashion wire markers from a series of joined wire markers each defined by a length of material having a hole at each end. The dispenser includes a housing of joined walls defining a hollow interior, a door providing access to the interior of the housing, a length of joined wire markers disposed within the interior of the housing, a slot communicating between the housing interior and the housing exterior and sized to permit passage of the wire markers from the housing interior to the exterior, a track disposed on the exterior of the housing adjacent the slot for guiding the wire markers after the wire markers exit the housing through the slot, means for cutting the length of wire markers into individual wire markers and means for indicating the advancement of an individual wire marker to a predetermined position for cutting.

The means for indicating the advancement of an individual wire marker to a predetermined position for cutting is an advancement slot within the track and in register with the holes of the wire markers when the wire markers are within the track, the advancement slot being terminated at a predetermined location spaced from the cutting means so that insertion of a pointed object through one of the holes in one of the individual wire markers and into the advancement slot will allow subsequent movement of the pointed object along the advancement slot towards the cutting means to advance the wire marker along the track toward the cutter until movement of the pointed object within the advancement slot is ended by termination of the slot, thus positioning the wire marker at the aforesaid predetermined position for cutting. The advancement slot may be a slot extending completely through a wall of the housing or may be a depression in the housing wall. The slot extends parallel to the direction of the wire marker track. When the advancement slot is a depression in the housing, there may be included at the terminal end of the slot a recess which extends further into the housing than the advancement slot so that the pointed object falls into the recess and provides a tactile indication that the terminal end of the advancement slot has been reached.

BRIEF DESCRIPTION OF THE DRAWINGS

The present invention will be more particularly described with reference to the accompanying drawings, wherein like numbers refer to like parts in the several views, and wherein.

DESCRIPTION OF THE PREFERRED EMBODIMENT

Figure 1:
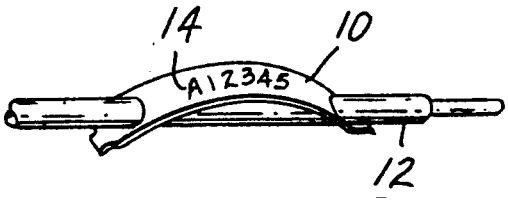
FIG. 1 PRIOR ART
FIG. 1 is a perspective view of a section of electrical wire having a wire marker attached thereto.

As stated above, the present invention is directed to a dispenser, generally indicated as 16, for wire markers 10 of the type illustrated in FIG. 1. The dispenser is intended to facilitate the handling of the wire markers 10 prior to their installation on a wire 12 to serve their intended identification purpose.

The dispenser 16 is comprised of a number of walls 18 which define a housing having an exterior surface and a hollow interior. The dispenser 16 is provided with a door 20 which is hinged and may be lifted to provide access to the interior of the dispenser 16. As an alternative, the dispenser 16 could be provided with a sliding or snap-in rather than hinged door 20 as illustrated.

Figure 3:
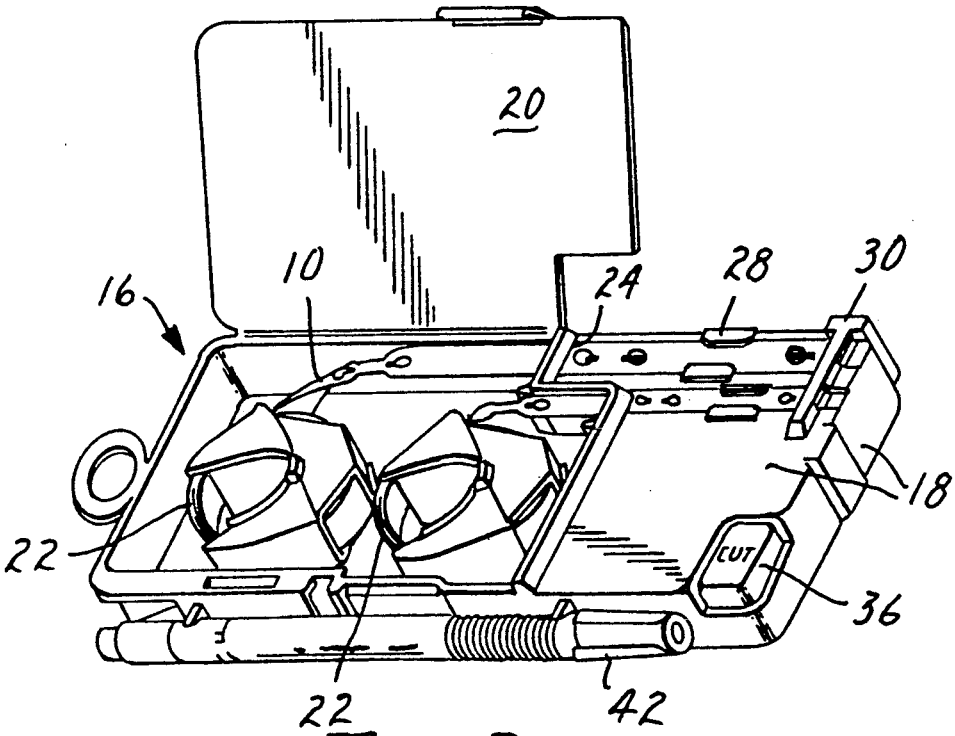
FIG. 3 is a perspective view of the wire marker dispenser of FIG. 2 with a door opened to illustrate the interior of the dispenser.

Individual wire markers 10 consist of a length of material, preferably a plastic, which is flexible and resilient and includes a surface or a coating which will accept typed, printed or written indicia 14. Each individual wire marker 10 includes a hole at each end which is sized to fit over a wire 12. It is contemplated in this invention that individual wire markers 10 will be provided in a reel or spool 22 wherein the individual wire markers 10 are joined end-to-end in a series. The dispenser 16 is sized to accept one or more of these spools 22 of wire markers 10 within its interior. The spools 22 may be replaced by lifting the door 20 and inserting the spool or spools 22 on a mount (not shown) disposed within the interior of the dispenser 16. FIG. 3 illustrates a dispenser 16 designed to accommodate two spools 22 of wire markers 10, the spools 22 including wire markers 10 of different lengths and widths and having different diameter holes to accommodate different diameter wires 12.

The dispenser 16 includes slots 24 which extend through the walls 18 of the dispenser 16 to allow the wire markers 10 to extend from the interior of the dispenser 16 to the exterior. Adjacent the slots 24 are tracks 26 which guide the wire markers 10 as they exit the slots 24 from the interior of the dispenser 16. The tracks 26 include inwardly-extending projections 28 which confine the wire markers 10 to the tracks 26 and at the end of the tracks 26 opposite the slots 24 there is located a bridge 30 which likewise confines the wire markers 10 to the tracks 26.

Figure 4:
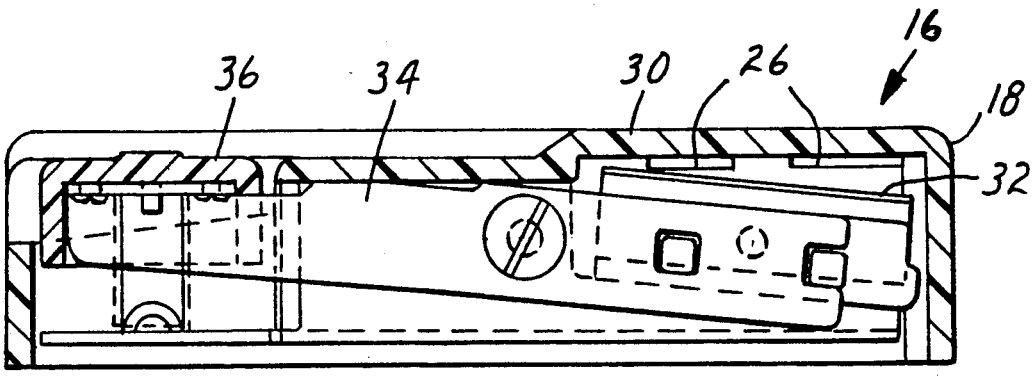
FIG. 4 is a cross-sectional view of the wire marker dispenser taken generally along the line 4—4 of FIG. 3.

As best seen in FIG. 4, there is disposed adjacent the bridge 30 a cutting mechanism consisting of a blade 32 which is operated through a lever 34 by pushing a key 36.

It should be recognized that the series of wire markers 10 must be cut at fairly precise positions to produce a serviceable individual wire marker 10. To be useful, each wire marker 10 must have a hole adjacent each end and the holes must be intact, i.e. a cut cannot extend into either hole. Thus it is of concern that the wire marker 10 be correctly positioned along the track 26 prior to cutting.

Figure 2:
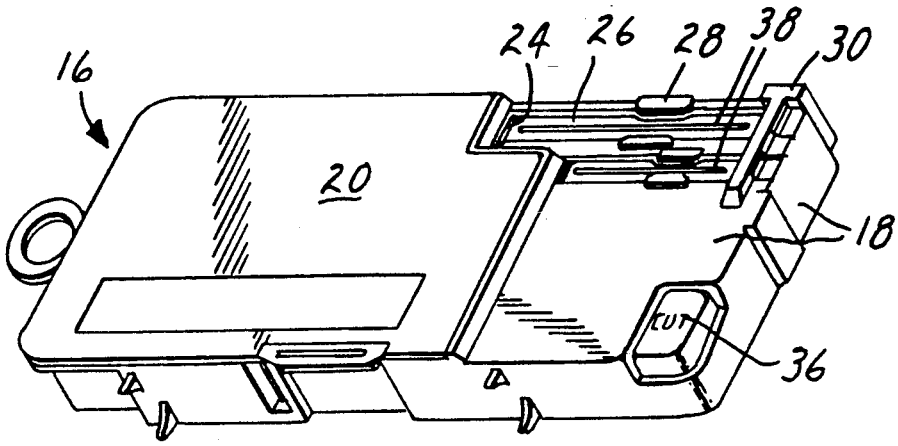
FIG. 2 is a perspective view of a dispenser according to the present invention for the wire markers of FIG. 1.
Figure 5:
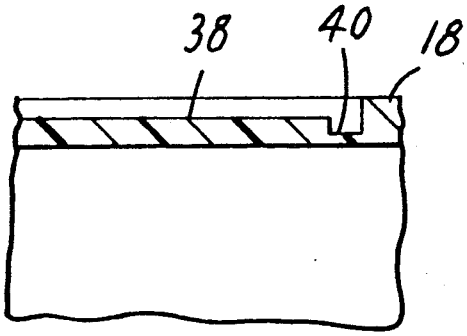
FIG. 5 is a cross-sectional view of a portion of an advancement slot of the wire marker dispenser.

Referring to FIGS. 2 and 5, there is located within the tracks 26 advancement slots 38 in the form of a longitudinal depression formed parallel to the direction of the tracks 26. These advancement slots 38 are located within the tracks 26 so as to be in register with the holes of the wire markers 10 when the wire markers 10 are properly located within the tracks 26. Since the advancement slots 38 are in register with the holes in the wire markers 10, a pointed object such as a tip of a marking pen or other stylus-shaped object may be inserted through the hole of the wire marker 10 to engage the advancement slot 38. Movement of the pointed object toward the bridge 30 and the cutting blade 32 will advance the wire marker 10 likewise toward the blade 32. The advancement slots 38 terminate at a predetermined position short of the bridge 30 at which point the overlying wire markers 10 are properly positioned with respect to the cutting blade 32. This proper position is with the cutting blade 32 disposed between the holes of adjacent wire markers 10 and not intersecting either of the holes.

The starting position of the advancement slots 38 is not critical, so long as the slots 38 extend sufficiently close to the beginning of the tracks 26 so that the leading hole of the next successive wire marker 10 overlies the advancement slot 38 when the prior wire marker 10 is located within the track 26 at the cutting position. This is because proper positioning of the wire marker 10 with respect to the cutting blade 32 depends upon the stylus being inserted through the leading hole of the next wire marker 10.

FIG. 5 illustrates that the advancement slot 38 may include a recess 40 located at its terminal end which extends farther into the wall 18 of the dispenser 16 than does the advancement slot 38. This recess 40 will allow the stylus to drop slightly when the stylus reaches the terminal end of the advancement slot 38 and thus provide a tactile indication that the end of the advancement slot 38 has been reached. It should be recognized that the depth of the advancement slots 38 is not critical and that the width of the advancement slots 38 is likewise not critical, so long as the advancement slot 38 has dimensions sufficient to accommodate the point of devices which are anticipated to be used to advance wire markers 10 to the cutting position. If it is not thought necessary to provide the recess 40 for tactile feedback, the advancement slots 38 may extend completely through the wall 18 of the dispenser 16.

In operation, the door 20 of the dispenser 16 is opened and a spool or spools 22 of wire markers 10 is inserted in the interior of the dispenser 16. The end of the wire marker 10 length is threaded through the slot 24 adjacent the door 20 and the first wire marker 10 advanced to the approximate position shown in FIG. 3. The door 20 may then be closed and the dispenser 16 is ready to dispense a series of wire markers 10. When it is desired to identify a wire 12, a pen 42 attached to a dispenser 16 may be used to write the desired indentifying indicia 14 upon the wire marker 10 which is completely exposed within the track 26. To advance the wire marker 10 containing the indicia to the cutting position, the tip of the pen 42 is inserted in the first hole of the next wire marker 10 and advanced along the advancement slot 38 to the end of the slot 38. The first wire marker 10 will then extend beyond the end of the dispenser 16 will be properly positioned for cutting. Depressing the key 36 will cause the cutting blade 32 to sever the extended wire marker 10 from the remaining wire markers 10 of the spool 22 for use and the next wire marker 10 will be properly positioned within the track 26 for marking as needed.

I claim:

1. A dispenser adapted to dispense in seriatim fashion wire markers from a series of joined wire markers each defined by a length of material including a hole at each end of the length of material, the dispenser comprising:

a housing of joined walls defining an open interior;

a door providing access to said interior of said housing;

a length of the joined wire markers disposed within said interior of said housing;

a slot communicating between said interior of said housing and the exterior of said housing and sized to permit passage of said wire markers from said housing interior to said housing exterior;

a track disposed on the exterior of said housing adjacent said slot for guiding said wire markers after said wire markers exit said housing interior through said slot;

means for cutting said length of wire markers into individual wire markers, said means for cutting disposed adjacent said track and opposite said slot; and an advancement slot within said track in register with said holes of said wire markers when said wire markers are disposed within said track, said advancement slot terminating at a predetermined location spaced from said means for cutting such that insertion of a pointed object through one of said holes in one of said individual wire markers and into said advancement slot and movement of said pointed object along said advancement slot toward said means for cutting will advance said wire marker along said track toward said means for cutting until movement of said pointed object within said advancement slot is ended by said termination of said slot, thus positioning said individual wire marker at said predetermined position for cutting.

2. A dispenser according to claim 1 wherein said advancement slot extends completely through a wall of said housing.

3. A dispenser according to claim 1 wherein said advancement slot is a depression in said housing extending parallel to said track.

4. A dispenser according to claim 1 further including a recess disposed at said termination of said slot which recess extends further into said housing then said advancement slot so that said pointed object falls into said depression upon reaching said termination of said slot to provide a tactile indication that the termination of said slot has been reached.

* * * * *